US006925775B1

(12) United States Patent
Smallwood, Sr.

(10) Patent No.: US 6,925,775 B1
(45) Date of Patent: Aug. 9, 2005

(54) APPARATUS FOR FILLING MARINE MATTRESSES

(76) Inventor: Joe L. Smallwood, Sr., 11 Wimbledom Ct., Statesboro, GA (US) 30458

( * ) Notice: Subject to any disclaimer, the term of this patent is extended or adjusted under 35 U.S.C. 154(b) by 0 days.

(21) Appl. No.: 10/794,868

(22) Filed: Mar. 8, 2004

(51) Int. Cl.[7] ..... B65B 1/04
(52) U.S. Cl. ..... 53/247; 53/235; 53/245; 53/249
(58) Field of Search ..... 53/235, 236, 245, 53/246, 249, 242; 414/42, 417

(56) References Cited

U.S. PATENT DOCUMENTS 3,780,883 A * 12/1973 Brown ..... 414/22.62
3,866,663 A * 2/1975 Hutton ..... 164/155.1
3,916,500 A * 11/1975 Brown ..... 29/240
4,344,523 A * 8/1982 May et al. ..... 198/418.3
4,898,495 A 2/1990 Lin
5,158,396 A 10/1992 Menard
5,259,696 A 11/1993 Beardsley
5,607,274 A * 3/1997 Cook ..... 414/111
5,876,151 A 3/1999 Brown, III et al.
5,899,632 A 5/1999 Martin
6,068,686 A * 5/2000 Sorensen et al. ..... 96/135
6,186,272 B1 * 2/2001 Atsalakis et al. ..... 182/63.1
6,195,960 B1 * 3/2001 Gjedebo ..... 53/245
6,283,321 B1 * 9/2001 Meshorer ..... 220/495.07
6,497,532 B1 12/2002 McGinn
6,648,579 B2 * 11/2003 Vartanian, Sr. ..... 414/546
6,826,892 B2 * 12/2004 Basque et al. ..... 53/410

* cited by examiner

*Primary Examiner*—Louis K. Huynh
*Assistant Examiner*—Hemant M. Desai
(74) *Attorney, Agent, or Firm*—William B. Noll

(57) ABSTRACT

An elongated, mobile apparatus for filling and depositing marine mattresses for use in erosion control. The apparatus comprises a frame system for supporting the apparatus on the ground and positioning for depositing an aggregate filled marine mattress at a desired location. The frame includes plural transverse support members fixedly mounting a like plurality of planarly aligned vertical support posts, where the vertical support posts includes a first forward facing wire mesh wall, and the support posts terminate in aligned free ends. Further included is a plurality of planarly aligned, second vertical support posts, where the second vertical posts are mounted for sliding engagement with the plural transverse support members. The second wall in a vertical orientation cooperates with the first wall to define an elongated space to receive a marine mattress container to be filled with aggregate, while in a horizontal orientation allows the filled container to be deposited on the ground. Further, wheels may be provided to facilitate movement of the apparatus from one location to another. Finally, to help settle the aggregate in the filled containers, a vibrating mechanism may be provided.

13 Claims, 5 Drawing Sheets

APPARATUS FOR FILLING MARINE MATTRESSES

FIELD OF THE INVENTION

This invention is directed to the field of apparatus suitable for filing and depositing marine mattresses, more particularly to mechanical apparatus for installing marine mattresses to control erosion at a shoreline, as a foundation for future construction, for an artificial reef, for a breakwater, and the like.

BACKGROUND OF THE INVENTION

The present invention relates to apparatus for filling and positioning marine mattresses for on-site installation on shorelines, for example. A marine mattress, as known in the art, is a generally rectangular polymeric container that is filled with aggregate, such as stone, and placed on shorelines to control erosion. However, they can also function as a foundation for future construction, such as a levee, breakwater, pipeline, building pad, and the like. It is not unusual that such filled mattresses can weigh up to eight tons. By way of example, the weight of a filled mattress is approximately 90 lbs. per sq. ft. of surface area of the filled mattress in a horizontal position. Thus, a 35'×5'×1' mattress would weigh about 15,750 lbs. For clarification and further understanding, a commercial mattress is manufactured by Tensar Earth Technologies under the trade name Triton Marine Mattresses.

On a typical construction project utilizing marine mattresses, the filling of the mattresses is usually performed at a site other than where the mattresses will eventually be placed. Quite often this site might be miles away with the filled mattresses stockpiled or stored until ready to be loaded onto a barge or truck for transport to the construction site for placement.

The filling of these mattresses in the past has been crude, and haphazard, and thus, a dangerous procedure. Prior art involved laying the mattress on its side (vertical) and securing it to a frame or posts to prevent it from falling over. One side of the mattress is left open permitting aggregate to be placed into the mattress utilizing a front-end loader. Once filled, the open side of the mattress is then closed and secured by braiding and the mattress lowered to a horizontal position. A crane, excavator, or other lifting device utilizing a spreader bar is typically used to lift the filled mattress by its two ends from the horizontal position. The mattresses are often stored in stacks on-site, loaded onto a truck or barge for transport, or occasionally transported by the crane or excavator for immediate placement, in cases where the filling site and the placement site are in close proximity and the placement site is accessible.

To date, the lowering of the mattresses to a horizontal position has been performed by utilizing a front-end loader, crane, or similar lifting device or by permitting the mattress to fall, often damaging the mattress. Additionally, the rigging utilized when attaching to a lifting device was often underrated, attached incorrectly, or not approved for this usage, and thus, potentially unsafe.

It is clear from the foregoing that there is serious concern for erosion control, particularly in the southeastern United States, specifically the Atlantic and Gulf coast, from hurricanes, where the storms from June to October cause significant damage to beach structures and beach erosion. Millions of dollars are lost each year in trying to correct erosion problems, and to repair the ultimate damage that will result from storm damage. Not only are there on-shore problems, but there are associated problems with immediate shorelines. While the prior art fails to address the on-shore problems, the direct interest of the present invention, the prior art does offer potential solutions for different submerged systems as reflected in the following U.S. Patents:

a.) U.S. Pat. No. 4,898,495, to Lin, discloses a beach/inlet stabilization system for bypassing the littoral drift to cross an inlet. The beach/inlet stabilization system consists of a well system, a diffuser system, a flow guiding system, a sediment trapping system, a dune drainage system and a water surface elevation sensor. The method thereof includes the steps of: (1) trapping the sediment carried by the littoral drift during flood tides and storms, with the sediment trapping system in the inlet during flood tides and storms, (2) regenerating the littoral drift by flushing the sediment trapping system when the ebb tidal current is weak, (3) directing the regenerated littoral drift by the diffuser system, located around the jetties between the inlet and the downstream beach, toward the downstream beach suffering from erosion or starvation of the littoral drift, (4) guiding the regenerated littoral drift toward the shore of the downstream beach, (5) lowering the ground water table of the downstream beach by the well system, (6) draining the excess ground water of the dune as the result of storm surges, adjacent to the downstream beach, and (7) sensing the water surface elevation and water flow velocity by the water surface elevation sensor, to generate control signals for the operation of the well system, the diffuser system, the sediment trapping system, the flow guiding system, and the drainage system.

b.) U.S. Pat. No. 5,158,396, to Menard, teaches a liquid confinement structure to control the depth of water contained by earthen levees in a rice field or the like, and to allow excess water to flow through a gate therein to prevent overflow and washout of the levees. The structure includes a horizontally elongated panel of rigid sheet aluminum for placement in a gap in an earthen water containment levee. The panel has a central cutaway portion closed by a rigid gate about eight inches high by about four feet wide articulated by a flexible strip joining the bottom of the gate to the horizontal edge of the cutaway portion. When the gate is tilted downward to permit water flow to lower the level of the water, the water is prevented from flowing around the ends of the gate by flaps forming seals between the edges of the gate and the edges of the opening in the panel. The gate element is held at a desired angle for controlling water level by a restraining chain at each end of the gate, the links of which may be captured in a slot in the top of the panel adjacent the cutaway portion. Openings at the extremities of the panel provide hand holds or means for engagement of hooks to facilitate installing, handling, or removing the structures.

c.) U.S. Pat. No. 5,259,696, to Beardsley, relates a system for rebuilding beaches which are subject to erosion of sand comprising a sheet of flexible impermeable material placed in the ocean near the shore and anchored to the water bottom with a plurality of landward tethers and a plurality of seaward tethers. A shoreward edge of the sheet parallel to the shoreline is weighted down. A seaward edge of the sheet, also parallel to the shoreline, may be provided with a float device to tend to raise the edge. As waves travel from the ocean toward the beach, the water is deflected under the sheet by the raised seaward edge, and into contact with sand and soil under the sheet, causing the sand and soil to move toward the beach. However, during the backwash of the wave, the weighted beachward edge of the sheet rests on the water bottom, deflecting the water over the sheet and out of contact with the sand and soil under the sheet, preventing movement of sand and soil away from the beach.

d.) U.S. Pat. No. 5,876,151, to Brown, III, et al., is directed to an underwater erosion control system that has viscous drag elements for increasing the effect of viscous drag and disrupting laminar flow on the water current having a frame that includes two longitudinal supports that extend along the length of the underwater erosion control system near its bottom portion. The longitudinal supports extend at opposite sides of the viscous drag elements. A plurality of rungs traverse the longitudinal supports and are spaced some distance apart from each other. The viscous drag elements may be panels secured to the rungs along their retaining portion. Apertures are formed within the retaining portion of the panels and are used to retain the panels from lateral movement by passing an inner support through the apertures parallel to the longitudinal supports. The frame may be flexible or rigid. A novel installation frame and a method for installing the rigid frame embodiment also are disclosed.

e.) U.S. Pat. No. 5,899,632, to Martin, discloses a beach building structure for underwater installation along the shoreline of a body of water having periodic onshore wave action. The structure includes a base frame adapted to rest on the bottom of the body of water, a ballast supporting member secured to the base frame in order to receive ballast such as rocks to help anchor the structure in position. A barrier plate is secured to the seaward portion of the base frame and is angularly disposed to slope upwardly and toward the shoreline and to extend above the mean water level to present a sloping surface to onshore waves.

f.) U.S. Pat. No. 6,497,532, to McGinn, teaches a structural member for use in erosion control and sediment retention. The structural unit has two adjacent shafts, both further having a cross sectionally triangular shape with a longitudinal side completely or substantially mostly removed to form legs. The leg ends are formed or machined such that they present two outward surfaces generally parallel to the open face of a first adjacent shaft. The outward surfaces of the leg ends are then positionally fixed, albeit with some flexible movement in some embodiments, to generally have a parallel and longitudinal interface with the longitudinal outside edges of a solid side of a second shaft. A stacked assembly may be formed from the structural members capable of sediment retention or accumulation.

From the above noted problems, and prior art attempts to solve the concern for erosion, nothing has been presented that provides the answers of this invention. The manner by which this may be accomplished will become more apparent in the description which follows, especially when read in conjunction with the accompanying Figures.

SUMMARY OF THE INVENTION

The present invention is directed to a stationary system, in an operating mode, for use in filling and depositing marine mattresses as a means to control erosion, but which is readily mobile to different site locations. The system hereof comprises a mattress supporting frame having a pair of outer transverse members, and plural, intermediate channel members, where said members are supported on the ground adjacent the location for depositing the mattress. Extending upwardly from said members are a first series of posts to define a rear wall for supporting operating personnel along a walkway, and a second series of intermediate posts. Between the respective series is an elevated walkway to allow operating personnel to monitor the loading and depositing of the filled mattress. As a safety precaution, the second series of posts, at their upper ends, is provided with an angled deflection plate to help direct the aggregate into the mattress containers. Finally, between the posts of the second series a wire mesh screen may be provided to permit visual inspection by the operating personnel. That is, such personnel can readily see any unfilled pockets, and allow them to effect additional compacting.

The frame may be fabricated from a variety of structural materials, such as steel, aluminum, wood, etc. Since the standard modular length of the frame may be about twenty feet, the frame may include means, such as flanges, for connecting adjacent such modular units in a continuous line. Additionally, the modular units may be provided with means for hoisting and moving the units to a second location. Cooperating with the second series of posts is a spaced apart, pivotal or hinged wall formed of a series of posts, where said posts in the mattress filling mode are vertically oriented and spaced from said second series of posts. Extending inwardly and laterally from the hinged wall of posts are plural arms, which arms are pivotal with said hinged wall of posts. For supporting the marine mattress during the filling operation, the hinged wall of posts and plural arms may be provided with continuous plates. In said filling operation, the hinged wall plate is spaced from the second series of posts and wire mesh and the aggregate container placed therebetween and on the plate overriding the plural arms. However, to accommodate differences in container sizes, where a preferred thickness is about twelve inches, to a maximum of about twenty four inches, the hinged wall is laterally adjustable. Adjustment is achieved by a plurality of downwardly extending, stationary members that are adapted to ride along the channels of said intermediate channel members, and a series of pistons, i.e, hydraulic, mounted on said intermediate channel members to effect lateral movement of the hinged wall. Additionally, when the pistons are fully extended the hinged wall is caused to pivot to a generally horizontal position allowing the filled mattress to be lifted by a crane and deposited on the ground. Finally, vibrating means may be provided to settle the aggregate and eliminate pockets during the filling process.

Accordingly, a feature of the invention is the provision of an adjustable apparatus for filling and depositing marine mattresses at selected locations.

Another feature of the invention hereof lies in the use of a hinged wall that pivots to a horizontal position to permit the mattress to be lifted by crane and deposited elsewhere.

Still another feature lies in the use of plural hydraulic pistons, that may be manually adjusted, to laterally adjust the depth of the aggregate container cavity to accommodate varying thicknesses of container sizes.

A further feature hereof is the provision of a safety walkway to allow operating personnel to observe the aggregate filling operation.

Another feature of the apparatus lies in the inclusion of a vibrating mechanism to facilitate settlement of the aggregate loaded into the mattress container.

These and other features of the invention will become more apparent in the description which follows.

DETAILED DESCRIPTION OF PREFERRED EMBODIMENT

Figure 1:
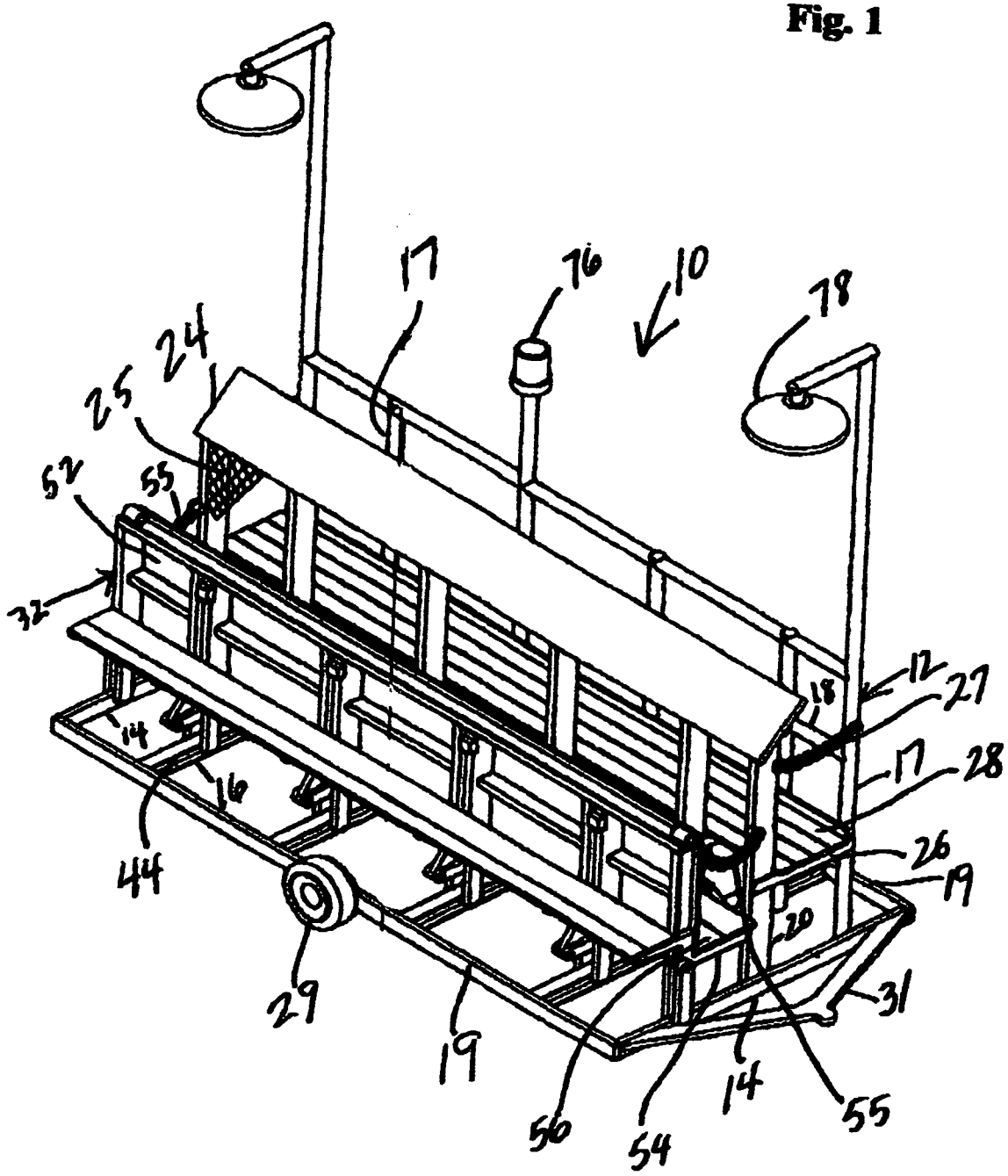
FIG. 1 is a perspective view of the apparatus for filling marine mattresses according to the present invention.

The present invention discloses mechanical apparatus for filling and depositing marine mattresses for the purpose of controlling erosion. The invention will now be described with regard to the various Figures, where like reference numerals represent like components or features throughout the various views.

Turning now to the several Figures, FIG. 1 is a perspective view of the marine mattress apparatus 10 according to this invention, where the apparatus is shown in the aggregate filling mode, but without the filling container. The apparatus 10 is adapted to rest on the ground, but may be provided with a variety of means to render the apparatus mobile to reposition the apparatus, as later discussed. In any case, the apparatus comprises a frame 12, fabricated of steel, aluminum and/or wood, featuring a pair of outer, transverse supports 14, a series of transverse channel members 16, and front and rear longitudinal frame supports 19 joined to the respective transverse supports and channel members. Additionally, a series of vertically oriented, rear posts 17 are secured to said transverse supports and channel members 14, 16, respectively. For added stability, support bars 18 may be provided. Additionally, a second series of posts 20, are secured, such as by welding, to the transverse supports 14 and transverse channel members 16. The respective top ends 22 of the second series of posts 20 include an angled deflection plate 24, the function of which will become clearer hereafter. Extending downwardly from the deflection plate 24 is a wire mesh wall 25 (only a portion being illustrated to prevent parts being hidden) is included. Between the respective posts 16, 20, specifically each transversely aligned pairs of posts, walk supporting members 26 are provided to receive a platform or walkway 28 for use by operating personnel in observing the filling operation, where for safety purposes, a removable chain 27 is provided.

As noted previously, mobility is important to allow the operating personnel to shift the apparatus to a second location. This may be accomplished by a pair of wheels 29 mounted at an intermediate position along the longitudinal frame supports 19, and by a detachable hitch arrangement 31 at one side of the apparatus. Though not illustrated, the wheels 29 may be retractable, by means known in the art, to allow the apparatus to rest on the ground for operating stability.

Figure 2:
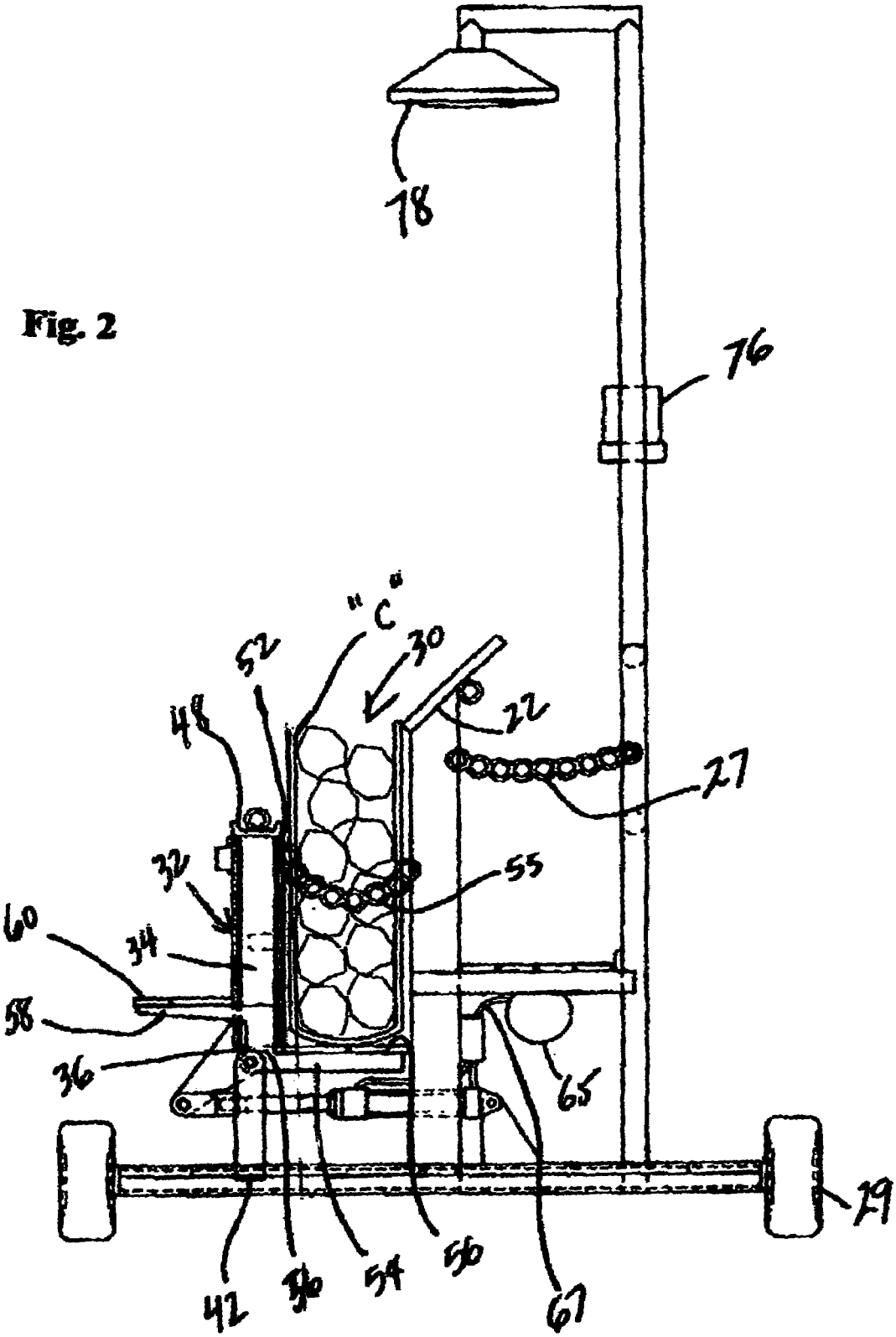
FIG. 2 is a side view of the apparatus of FIG. 1, further showing an aggregate filled marine mattress.

Cooperating with the posts 20 and mesh wall 25, to define an aggregate receiving channel 30, see FIG. 2, is a transversely adjustable and pivotal wall 32. The adjustable and pivotal wall, as illustrated in FIGS. 2 through 5, comprises a plurality of L-shaped members 34, where the junction 36 is pivotally mounted to a like number of vertical pairs of supports 38 at the upper end 40. The lower end 42 of the supports 38 are adapted to slidably engage a transverse support 14 or channel member 16. As to the latter members, though not illustrated, the lower ends may include opposing, inwardly directed flanges or opposing rollers to ride within the side channels 44. In any case, a first leg 46 of the respective L-shaped members 34 are joined together by a U-shaped channel 48, while adjacent said first legs 46, at intermediate locations, may be joined by support braces 50. Overriding the first legs is a continuous plate 52 facing the spaced apart series of posts 20.

The second legs 54, shown horizontally oriented in FIGS. 1 and 2, mount a length of planks 56 or panels forming a platform for supporting the aggregate container "C" (FIG. 2). This platform, in combination with the mesh wall 25 and continuous plate 52, forms a receptive channel for temporarily containing the aggregate container "C". For security, and to help contain the filled container "C", a removable chain 55 way be provided. As an option, the second legs 54 may be Z-shaped with the midportion 56 secured to the first leg, and a further portion 58 extending perpendicular to the first leg 46. This series of further portions may mount a platform 60 that can function as a platform for operating personnel to observe the filling operation. Also, as best seen in FIG. 5, the further portions 58 and platform 60 can serve as a stabilizing support, resting against the transverse supports and channel members 14, 16.

Figure 5:
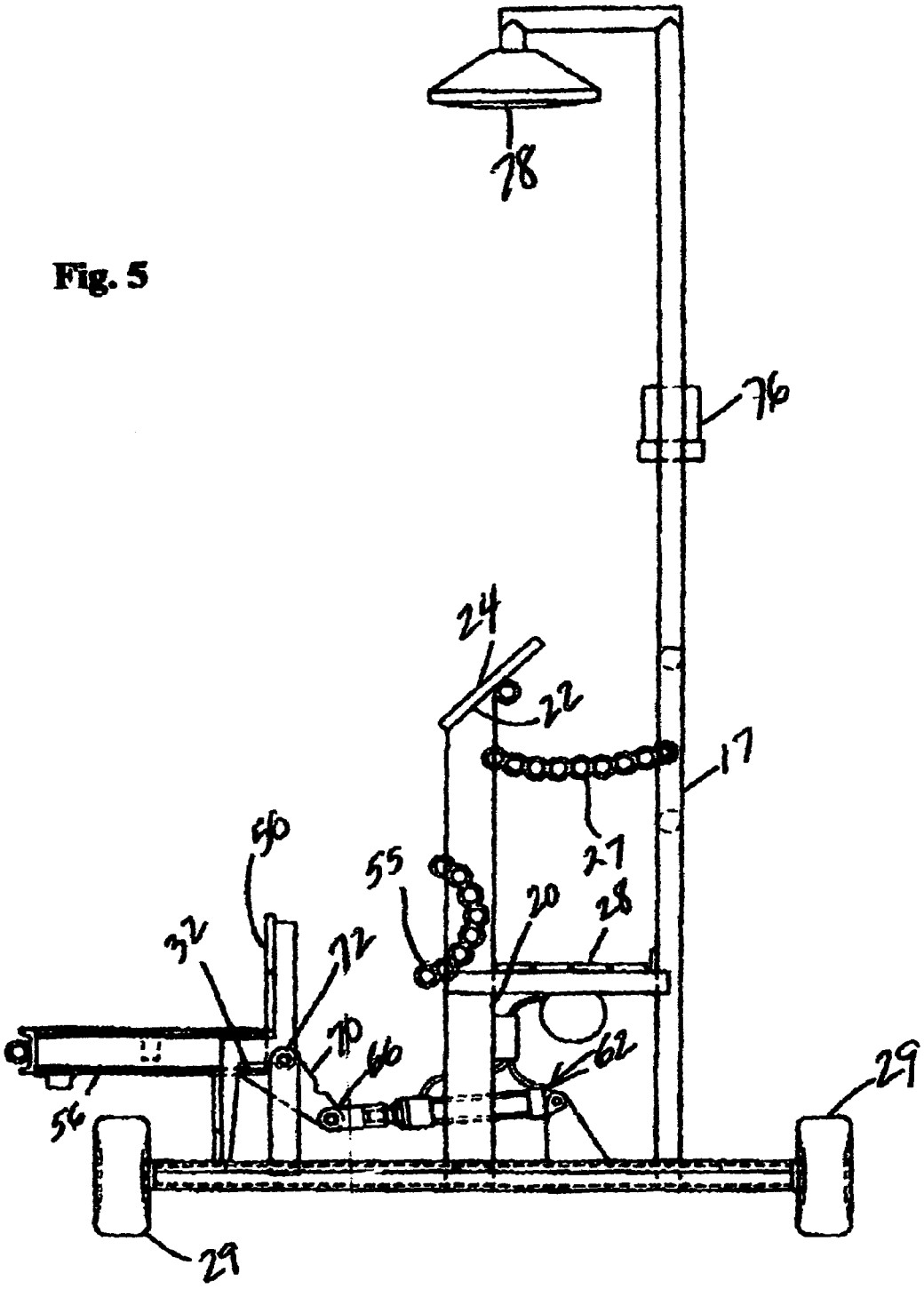
FIG. 5 is a side view of the apparatus of FIG. 4.

Transverse adjustment and pivotal movement of the pivotal wall 32 is accomplished by a series of hydraulic pistons 62, where each piston is mounted by a bracket 64 to a respective said intermediate channel member 16, see FIGS. 2 and 5, where the respective pistons 62 are connected by a manifold 65 and hydraulic lines 67 to simultaneously operate the pistons, as best seen in FIG. 5, where said hydraulic pistons may be operated by a hydraulic pump mounted on the filling frame and powered by an auxillary generator or by a permanent power source. The free end 66 of the extendible piston rod 68 mounts a pivotal bracket 70, where the free bracket end 72 pivots about the upper end 40 of a respective pair of supports 38. Additionally, the pivotal bracket 70 is secured to the pivotal wall 32, or alternatively to the midportion 56 of the Z-shaped second leg. By this arrangement, comparing the views of FIGS. 2 and 5, it will be seen that in the loading mode of FIG. 2, xtended piston rod 68, the pivotal wall is vertical, whereas, in the epositing mode of FIG. 5, retracted piston rod, the pivotal wall 32 is orizontal and to allow a crane or other similar mechanism to lift and eposit the aggregate filled container "C". Finally, to ensure a compact aggregate, a vibrating mechanism 73 may preferably be mounted on a vertical frame support.

Figure 3:
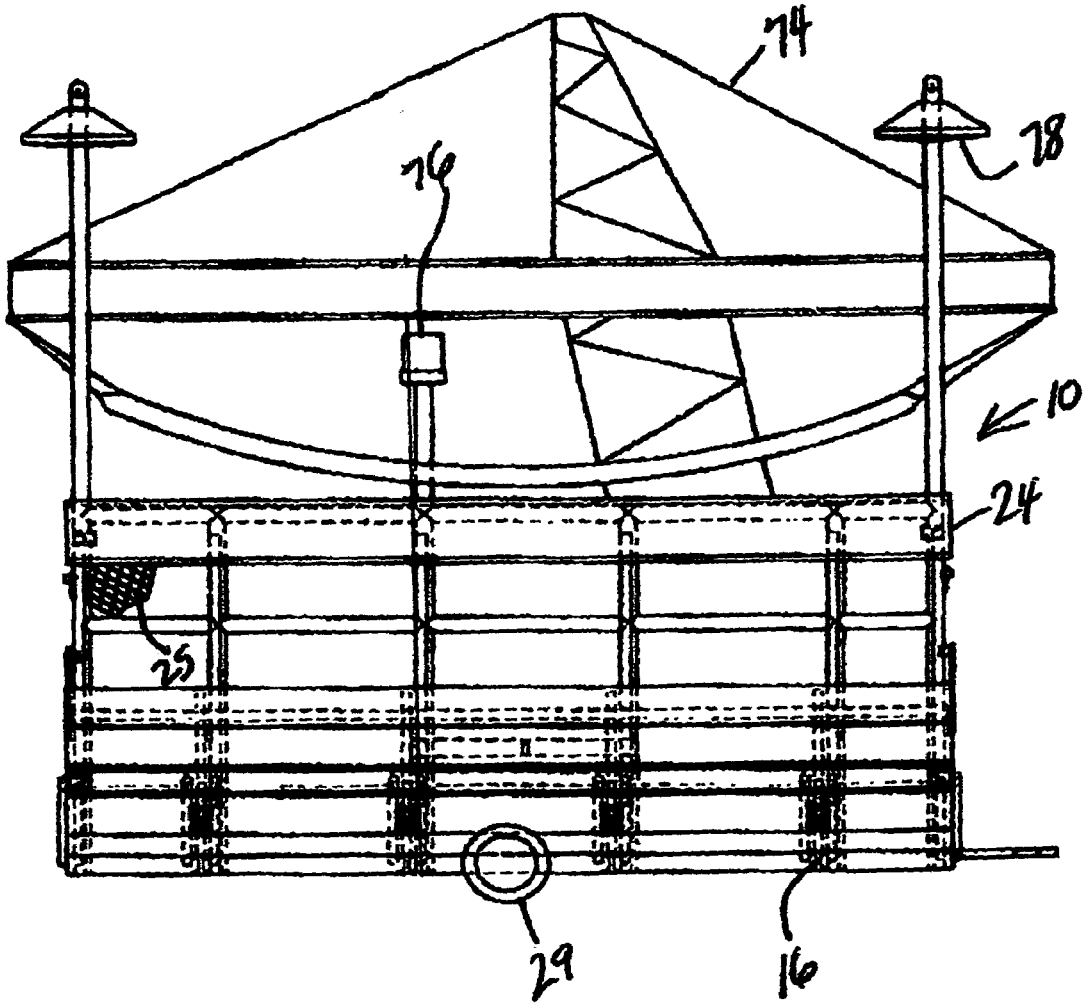
FIG. 3 is a front view of the apparatus of FIG. 1, further showing a crane structure used to fill the marine mattress with aggregate.
Figure 4:
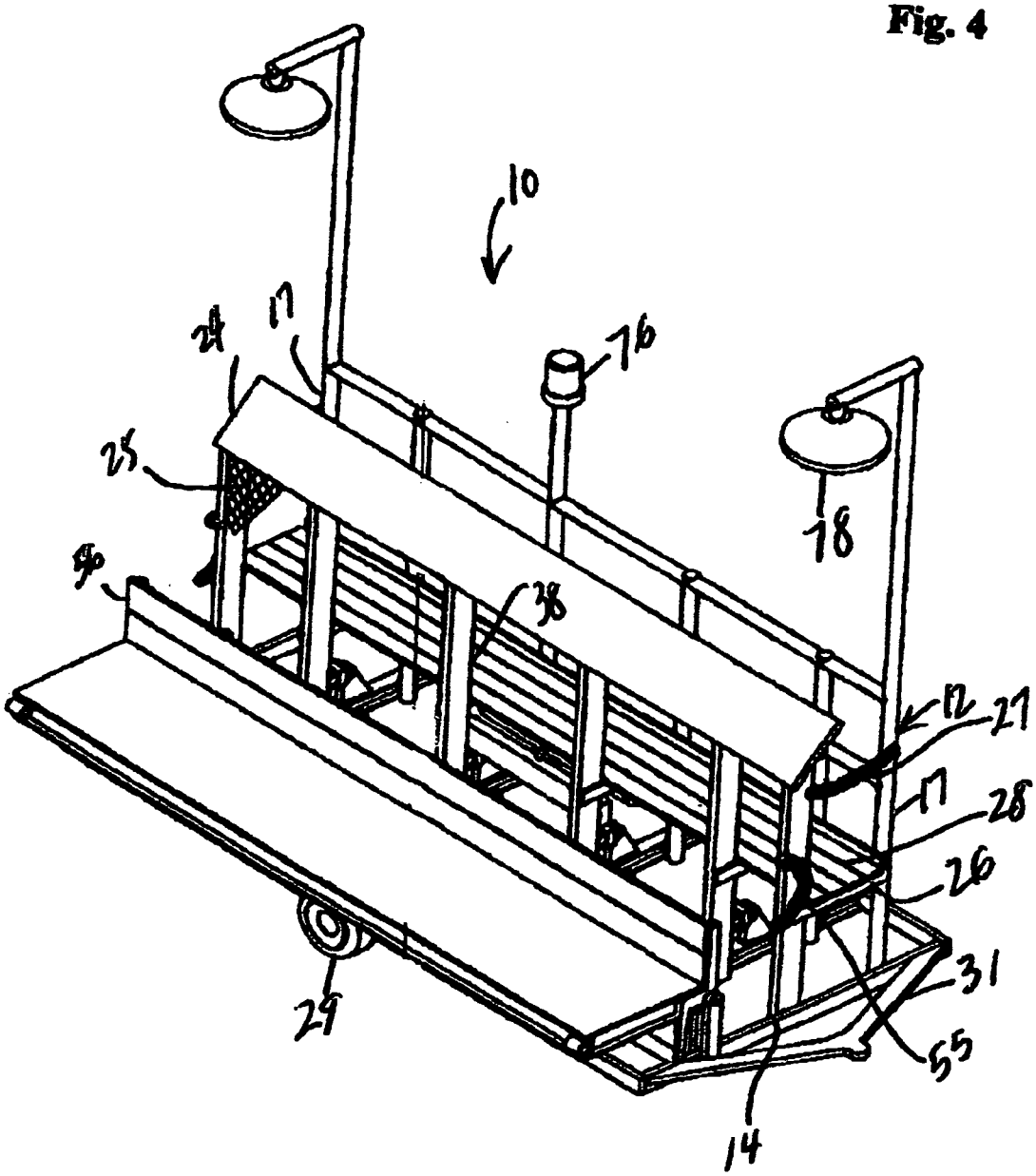
FIG. 4 is a perspective view, similar to FIG. 1, showing the apparatus in a pivoted unloading mode.

Returning to FIGS. 2 and 3, FIG. 2 shows the aggregate container "C", typically a meshed polymeric material, is open at the top to allow filling of the container. FIG. 3 shows a simulated crane 74 for feeding the aggregate to the container "C". In the alternative, a front-end loader, as known in the art, may be employed to load the aggregate. Once the container is filled, the top may be closed and secured by braiding. Thereafter, by retracting the piston rod (FIG. 5), the secured container "C" may be dropped or deposited laterally onto the ground.

To satisfy possible OSHA regulations, and to ensure that operating personnel are protected and others are aware of the presence of personnel in proximity of the apparatus, a strobe light 76 or audible alarms may be activated as desired, as well as elevated lighting 78 to oversee the entire apparatus.

It is recognized that changes, variations and modifications, especially by those skilled in the art, to the marine mattress apparatus according to this invention. Accordingly, no limitation is intended to be imposed thereon except as set forth in the accompanying claims.

I claim:

1. An elongated, mobile apparatus for filling and depositing marine mattresses, said apparatus comprising:

a frame system for supporting said apparatus on the ground and positioned for depositing an aggregate filled marine mattress at a desired location, said frame including a.) plural transverse support members fixedly mounting a like plurality of a first set of planarly aligned vertical support posts, where said vertical support posts include a first forward facing wire mesh wall, and said support posts terminate in aligned free ends; and, b.) a transversely adjustable and pivotal second wall formed by a plurality of planarly aligned, second vertical support posts, where said second vertical posts are mounted for sliding engagement with said plural transverse support members, said second wall in a vertical orientation cooperating with said first wall to define an elongated space to receive a marine mattress container to be filled, and in a horizontal orientation to allow the said filled container to be deposited laterally onto said ground.

2. The elongated, mobile apparatus according to claim 1, wherein said pivotal second wall comprises an L-shaped subframe with a first leg thereof formed by said second vertical support posts, and a second leg perpendicular to said first leg, said second leg defining a support base for said container to be filled.

3. The elongated, mobile apparatus according to claim 2, wherein said first and second legs are further defined by continuous face plates.

4. The elongated, mobile apparatus according to claim 2, wherein said L-shaped subframe includes forwardly projecting arms for receiving a flooring for use in supporting operating personnel in observing the filling operation.

5. The elongated, mobile apparatus according to claim 1, including plural hydraulic pistons, adjustably mounted on said plural transverse support members to transversely adjust said second wall to said first wall, and to effect a pivoting of said second wall.

6. The elongated, mobile apparatus according to claim 5, including a manifold connecting said plural hydraulic pistons to effect the simultaneous operation thereof.

7. The elongated, mobile apparatus according to claim 6, including a second set of vertical posts spaced rearwardly from said first set of vertical support posts, and a set of transverse support arms extending between said first and second said sets, where said support arms mount a walkway for use by operating personnel to observe the filling operation.

8. The elongated, mobile apparatus according to claim 5, wherein at least said innermost transverse support members, to which said hydraulic pistons are mounted, are channel configured and that said sliding engagement is along said channel configured support members.

9. The elongated, mobile apparatus according to claim 1, wherein said free ends of said support posts mount an angled deflection plate for the aggregate delivered to said container, and a mesh screen underlying said deflection plate to allow for visual inspection of the container to be filled with aggregate.

10. The elongated, mobile apparatus according to claim 1, wherein said plural transverse support members are characterized by first and second ends, said ends being joined by a pair of longitudinal frame supports mounting a pair of retractable or removable wheels to facilitate movement of said apparatus.

11. The elongated, mobile apparatus according to claim 10, including a removably mounted trailer hitch mounted at one end of said apparatus.

12. The elongated, mobile apparatus according to claim 1, including a vibrating mechanism to effect settlement of the said aggregate filled marine mattress.

13. The elongated, mobile apparatus according to claim 1, including safety lights and audible alarms for activation when operating personnel are present on the apparatus.

* * * * *